United States Patent [19]

Kloenne

[11] Patent Number: 4,463,947

[45] Date of Patent: Aug. 7, 1984

[54] KNEE AND LEG ORTHOPEDIC EXERCISING DEVICE

[75] Inventor: Arthur F. Kloenne, Louisville, Ky.

[73] Assignees: Steve Green; Vicki Green; Daniel A. Kloenne; Greg E. Kloenne; Amy E. Kloenne, all of Louisville, Ky.

[21] Appl. No.: 375,502

[22] Filed: May 6, 1982

[51] Int. Cl.[3] ..... A63B 23/04

[52] U.S. Cl. ..... 272/116; 272/127; 272/143

[58] Field of Search ..... 272/96, 116, 126, 127, 272/134, 135, 138, 142, 143, 144, 145, 146, 900; 128/25 R

[56] References Cited

U.S. PATENT DOCUMENTS

| | | | |
|---|---|---|---|
| 309,678 | 12/1884 | Aubin | 272/144 X |
| 1,734,238 | 11/1929 | Sweeney | 272/142 X |
| 2,615,503 | 10/1952 | Enge | 297/438 |
| 2,855,198 | 10/1958 | King | 272/145 X |
| 3,876,198 | 4/1975 | Seligman | 272/142 X |
| 4,229,001 | 10/1980 | Roman | 272/96 |

FOREIGN PATENT DOCUMENTS

| | | | |
|---|---|---|---|
| 71384 | 8/1950 | Denmark | 272/138 |
| 1536967 | 7/1968 | France | 128/25 R |

*Primary Examiner*—Richard T. Stouffer
*Attorney, Agent, or Firm*—Richard L. Caslin

[57] ABSTRACT

A knee and leg orthopedic exercising device is shown for use by a person that is seated in a chair. The device itself is a wide leg rest that may accommodate both legs of the user, although it could be used for one leg at a time. This leg rest has a side profile of an inverted capital T having a vertical shank portion that is supported from a generally perpendicular crown portion. The edge of one end of the crown portion is provided with an elongated roller which is adapted to roll upon a floor surface. The top side of the side of the crown portion which is remote from the roller serves as a footrest, while the side of the shank portion of the leg rest which is remote from the roller serves to support the shank of at least one of the legs of the user. This leg rest is provided with holding straps for holding the shank portion of the leg rest against the underside of the shank portion of the user's leg as the user flexes the leg between a vertical and an inclined, outstretched position. Two modifications of these holding straps are shown. One modification includes a pair of hand straps to be engaged by the user's hands for exerting a pulling force and ensuring that the crown portion of the leg rest remains against the foot or feet of the user. A second modification of holding straps is the use of a pair of leg straps which are wound around the user's legs and around the shank portion of the leg rest to bind the leg to the leg rest so that they move in unison.

3 Claims, 6 Drawing Figures

KNEE AND LEG ORTHOPEDIC EXERCISING DEVICE

BACKGROUND OF THE INVENTION

1. Field of the Invention

This invention relates to an orthopedic exercising device for use in exercising the knee and leg of a patient.

2. Description of the Prior Art

There are several early patents that show leg and footrests, but none could be found for use as an orthopedic exercising device. One leg and footrest is shown in the Walker U.S. Pat. No. 1,315,264. This patent shows a footrest having a supporting leg and a generally horizontal shelf that extends laterally from the supporting leg. This Walker leg rest is for use by a person sitting in a chair without the necessity of connecting the footrest to the chair in any manner. This leg rest is not capable of use as an exercising device.

There is also the Brown et al. U.S. Pat. No. 2,140,310 which describes a leg rest which can also be used as a portable seat as well as a back rest, and it also is collapsible for ease in storage, but again this is not usable as an exercising device.

Then there is the Enge U.S. Pat. No. 2,615,503 which shows a foot and leg rest which is a collapsible device that is adapted to balance on a single floor-engaging leg member that is free from hinges, tie rods, brackets or shelves. In addition to the floor-engaging panel, there is a foot and leg supporting panel, so that one panel mates with the other in a slip-fit relationship. Again, this foot and leg rest is not usable as an exercising device.

Next, there is the Confer U.S. Pat. No. 4,067,614 which describes a footstool with a unique connection of a support member to a perpendicular base member. This patent is not usable as an exercising device.

OBJECTS OF THE PRESENT INVENTION

The principal object of the present invention is to provide a knee and leg orthopedic exercising device for therapeutic use by a person sitting in a chair that is capable of different degrees of participation or activity, depending upon the condition of the user.

A further object of the present invention is to provide a knee and leg exercising device which includes a wide leg rest having a supporting leg portion and a generally perpendicular shank portion, and holding means for holding the supporting leg against the feet of the user.

A further object of the present invention is to provide an exercising device in combination with a floor platform to ensure a good rolling action of the exercising device.

A further object of the present invention is to provide an exercising device with suitable hand straps so that the user's hands and arms may serve to assist the exercise of the legs and knee.

A further object of the present invention is to provide an exercising device with a floor platform having stop means for limiting the degree of movement of the leg rest in its rolling action.

SUMMARY OF THE INVENTION

The present invention provides a knee and leg orthopedic exercising device for use by a person in a seated position. This exercising device includes a wide leg rest that is capable of supporting both legs of the user. This leg rest has a side profile of an inverted capital T having a vertical shank portion that is supported from a generally perpendicular crown portion. This crown portion serves as the supporting leg of the device, and the lower edge of this crown portion has an elongated roller means which is adapted to roll upon a floor surface. The shank portion of the leg rest is mounted generally perpendicular to the crown portion, and the upper side of this shank portion serves to support the shank of the legs of the user. The underside of the crown portion which is remote from the said roller means serves as a footrest. This leg rest is provided with holding means for holding the shank portion of the leg rest against the underside of the shank portion of the user's legs as the user flexes the legs between a vertical and an inclined, outstretched position.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
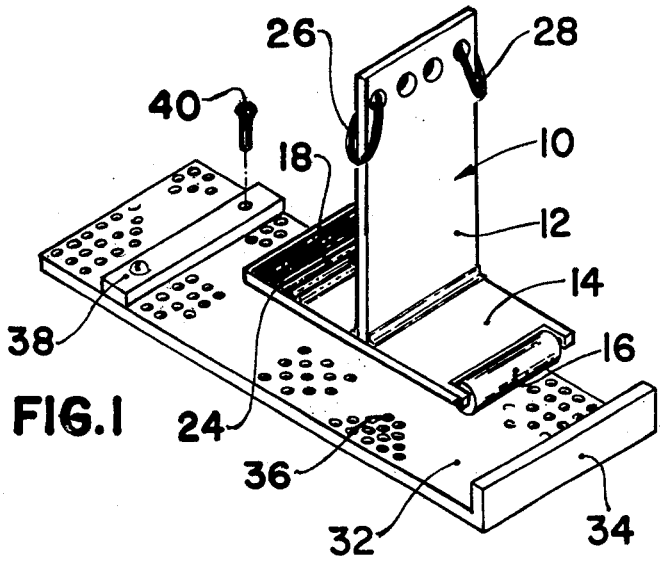
FIG. 1 is a perspective view of a knee and leg orthopedic exercising device comprising the present invention which includes a wide leg rest that has a side profile of an inverted capital T in combination with a floor platform on which the roller means of the leg rest is supported for a rolling action as the leg and knee are flexed.
Figure 3:
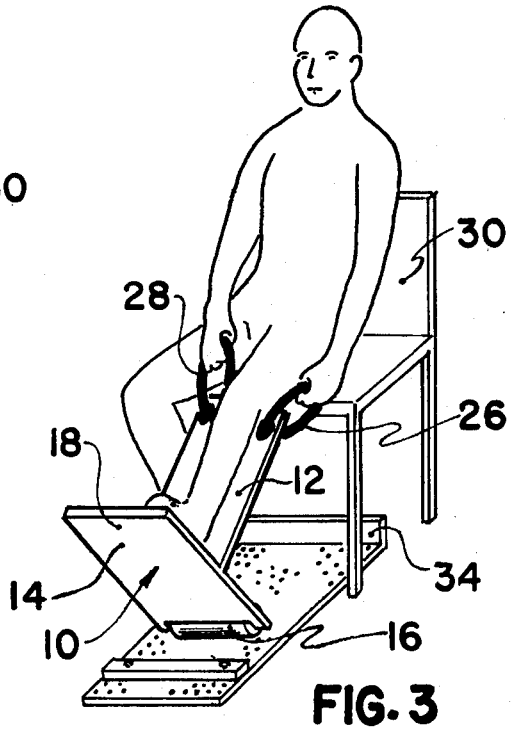
FIG. 3 is a perspective view, similar to that of FIG. 2, showing the user raising his left leg and the leg rest moving on its lower roller means, while the user is pulling back on the hand straps to keep the leg rest pulled tight against the underside of the user's foot.

Turning now to a consideration of the drawings, and, in particular, to the perspective view of FIG. 1, there is shown a wide leg rest 10 that is shown in an at-rest position, but actually it has a side profile of an inverted capital T with a vertical shank portion 12 that is supported by a generally perpendicular crown portion 14. In actual use, this leg rest 10 is not used in the position as shown in FIG. 1. In use, it is in a position as best seen in FIG. 3. The crown portion 14 may be considered as the supporting leg or base of the leg rest, and the lower edge of this crown portion is provided with an elongated roller means 16 that is adapted to roll upon a floor surface. The topside of the side 18 of the crown portion 14 that is remote from the roller means 16 serves as a footrest for one or both of the user's feet 20.

Figure 2:
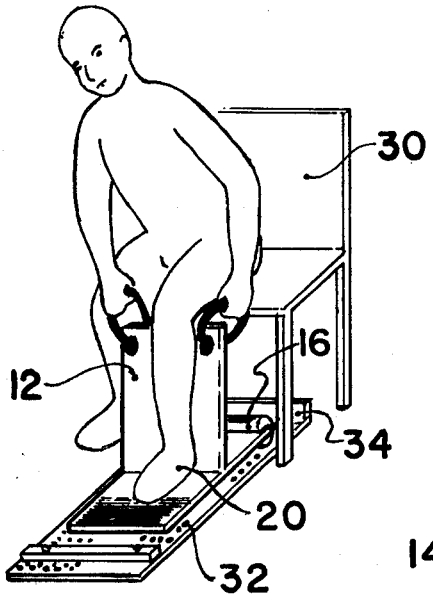
FIG. 2 is a perspective view of a user seated in a chair with the floor platform positioned in front of the chair and the user with his left leg mounted in the leg rest in an at-rest position in preparation for beginning the leg exercises. Notice the hand straps on the sides of the leg rest for use by the user in augmenting the action of the left leg.

The roller means 16 is elongated to give stability to the leg rest 10 as it moves from the position shown in FIG. 2 to the position shown in FIG. 3. Moreover, the diameter of the roller 16 is larger than the thickness of the crown portion 14 of the leg rest, so that the roller serves as the support means for the leg rest during the exercising activity. As seen in FIG. 1, the footrest 18 may be provided with a pad 24 to prevent slippage of the foot during the exercising activity. The shank portion 12 of the leg rest 10 has a pair of hand straps 26 and 28 so the user may grasp the straps and pull back so that the footrest 18 will always be against the underside of the user's foot 20. In the at-rest position of FIG. 2, the shank portion 12 of the leg rest 10 is positioned just behind the user's left leg, with the left foot 20 resting on the footrest 18. The roller 16 is positioned slightly under the front of the chair 30. Notice in FIG. 4 that the roller is in contact with the floor platform 32 in this at-rest position.

For practical purposes, the roller means 16 doesn't operate very well on a carpet surface. It is for this reason that a floor platform 32 is provided in conjunction with the leg rest 10 to provide a track of hard surface for the roller means 16 to travel across. It is well to provide the floor platform 32 with a stop member 34 to limit the rearward travel of the roller 16, because it is easier to lift this leg rest 10 if the leg rest has not returned to its full at-rest position of FIG. 2. In other words, if the stop member 34 were brought forward in FIG. 2, then it would not be possible to lower the crown portion 14 to the horizontal position resting completely on the floor platform 32.

FIG. 1 shows the floor platform 32 made of a peg board material with a plurality of holes 36 so that a second stop member may be adjustably mounted on the floor platform 32 by means of pins 40. The reason that this second stop member 38 should be adjustable is that its position would be determined by the size of the legs of the user as well as the physical condition of the user to withstand physical exercise.

Figure 4:
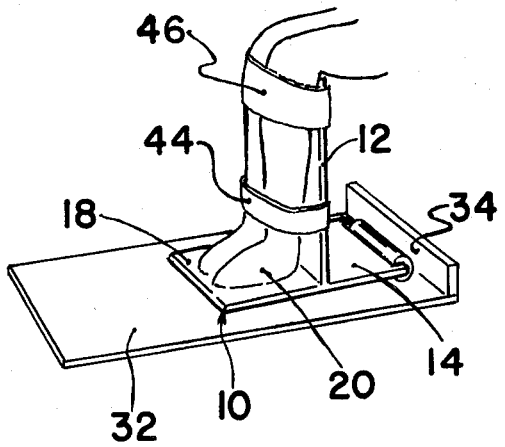
FIG. 4 is a fragmentary, perspective view showing a second modification of the present invention where the use of the pair of hand straps have been replaced by the use of a pair of leg straps that encircle both the shank portion of the leg rest and the shank portions of both of the user's legs so that the leg rest will be attached to these legs and move therewith as the legs are flexed, while the user's hands are free.
Figure 5:
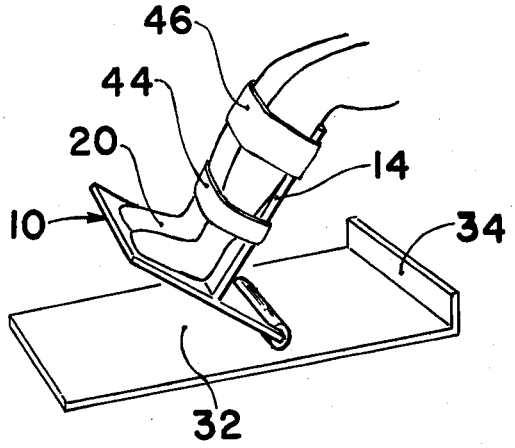
FIG. 5 is a fragmentary view, similar to that of FIG. 4, showing the user raising both legs and the leg rest moving on its lower roller means.
Figure 6:
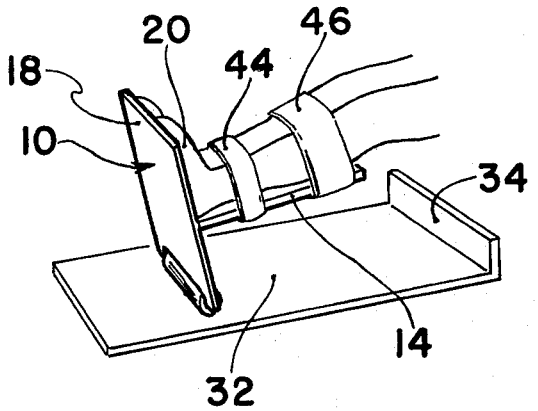
FIG. 6 is a fragmentary view, similar to that of FIGS. 4 and 5, where the user's legs are in a full, outstretched position and the leg rest is almost in its most vertical position.

FIGS. 4–6 show a second modification of the present invention where the same parts are identified with the same reference numerals as used above. While the hand straps 26 and 28 aren't shown in FIGS. 4–6, they could be present on the shank portion 12 of the leg rest 10, although in this second modification the hand straps 26 and 28 would not be used. In place of the hand straps, there are a pair of straps 44 and 46 which are preferably of Velcro material that are easily applied to encircle both the shank portion 12 of the leg rest 10 as well as the two legs of the user. These straps should be applied tightly so that the user's arms would not be used during the use of this second modification of the invention of FIGS. 4–6. If the straps 44 and 46 are applied properly, the leg rest will be attached to the user's legs and move therewith. Notice that the roller 16 is in contact with the floor for ease in starting movement of the leg rest.

Having described above the several modifications of the present invention, it will readily be apparent to those skilled in this art that the leg rest 10 and floor platform 32 of the present invention are easily portable and of light weight. A preferred embodiment uses a quality grade hardwood to ensure durability and maximum support. This invention has been developed for use in the therapeutic situation involving gentle, passive or active exercise as is necessary in a variety of leg and knee problems. These conditions include post-surgical rehabilitation, total knees, sports injuries, arthritic-rheumatoid stiffness, stroke-related limb disability, circulation and muscular development, and joint movement inability caused by obesity.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A knee and leg orthopedic exercising device for use by a person in a seated position in a chair comprising:

a. a wide leg rest of integral construction having a side upright profile of an inverted capital T with a vertical shank portion that has a free distal end and is supported from a base portion generally perpendicular thereto at the other end of the vertical shank;

b. the base portion including one free edge which is remote from the shank portion having an enlarged roller means which is adapted to be able to contact a floor surface when the base portion is at rest on the floor surface for ease in moving the leg;

c. the side of the shank portion of the leg rest which is remote from the said roller means serving as a support for the shank of at least one of the legs of the user;

d. the topside of the side of the base portion which is remote from the said roller means serving as a footrest;

e. and strap holding means for holding the shank portion of the leg rest against the underside of the shank portion of the user's leg as the user flexes the leg between a vertical at-rest position and an inclined, outstretched leg position, said strap holding means comprising first at least a pair of leg straps which are capable of being fastened around both the user's leg and around the leg rest, with the effect that when the leg rest is attached to the user's leg, the leg rest moves therewith during active exercise of the leg, and said strap holding means also comprises at least one hand strap that is attached to the shank portion of the leg rest adjacent the distal end thereof so that the user may use his hand and arm to pull back on the hand strap so as to hold the leg rest tight against the user's foot as well as in contact with the shank portion of the user's leg.

2. The invention as recited in claim 1, with the addition of a planar floor platform to serve as a hard surface track for the said enlarged roller means to ensure a good rolling action of the leg rest, said floor platform including at least one stop member adjacent one end of the platform that is closest to the user for limiting the travel of the roller means toward the user.

3. A knee and leg orthopedic exercising device for use by a person in a seated position in a chair comprising:

a. a leg rest of integral construction having a first shank portion and a second foot portion, where the said foot portion is attached to one end of the shank portion and is generally perpendicular thereto and where the other end of the shank portion is a free distal end;

b. the foot portion having a lower extension that is provided with an enlarged roller means on the bottom edge thereof that is adapted to be in contact with the floor when the foot portion rests on the floor and the shank portion is vertically disposed;

c. and strap holding means adapted for holding the said shank portion of the leg rest against the underside of the shank portion of the user's legs as the user flexes the legs between a first vertical at-rest position and a second inclined outstretched leg position, said strap holding means comprising a pair of leg straps which are capable of being fastened around both the user's leg and around the leg rest with the effect that when the leg rest is attached to the user's leg, the leg rest moves therewith during active exercise of the leg, and said strap holding means also comprising a pair of hand straps that are attached to the shank portion of the leg rest adjacent the distal end thereof so that the user may use both of his arms to pull back on the hand straps so as to hold the leg rest tight against the user's foot as well as in contact with the shank portion of the user's leg during passive exercise of the leg;

d. and a planar floor platform to rest on the floor and serve as a hard surface track for the said roller means to insure a good rolling action of the leg rest, said floor platform including a stop member adjacent one end thereof that is nearest to the user for limiting the amount of travel of the roller means towards the user.

* * * * *